United States Patent [19]

Krishnan

[11] 4,213,608

[45] Jul. 22, 1980

[54] GAME RACQUETS

[76] Inventor: Mithra S. Krishnan, 1041 Township Line Rd., Jenkintown, Pa. 19046

[21] Appl. No.: 942,949

[22] Filed: Sep. 15, 1978

[51] Int. Cl.[3] ..... A63B 19/02

[52] U.S. Cl. ..... 273/73 C; 273/73 R; 273/73 D

[58] Field of Search ..... 273/73 R, 73 C, 73 D, 273/73 E

[56] References Cited

U.S. PATENT DOCUMENTS

| | | | |
|---|---|---|---|
| 2,670,958 | 3/1954 | Leiser | 273/73 R |
| 3,734,499 | 5/1973 | Goldstein | 273/73 R |

*Primary Examiner*—Charles E. Phillips

[57] ABSTRACT

A radical new game racquet consisting of a frame and ball contacting facing surfaces which can move with respect to the frame. The facing is capable of having a nonnegligible velocity in a plane tangent to the facing at a given point. The facing motion is used to produce extra spin on the ball. The facing motion can be produced by a variety of means, which are further described in the text.

7 Claims, 2 Drawing Figures

GAME RACQUETS

BACKGROUND OF THE INVENTION

Game racquets for games played with a ball such as tennis, squash, racquetball, ball badminton, table tennis, and so on have traditionally been made of a relatively rigid frame comprising a handle and a head, with a facing of a criss-cross network or mesh of strings of some sort attached under tension to the rigid rim of the head. The traditional racquet as a whole is thus an integral unit, and no part of the racquet has any significant freedom of motion with respect to the rest of the racquet. The size and shape of racquets for each of the various sports have also remained relatively unchanged over the years, though a few notable exceptions such as the large head tennis racquet, Prince, do exist. Such a lack of innovative development in racquet design is somewhat surprising, especially as in several sports, tennis to name one, there are absolutely no regulations regarding the design of racquets.

One of the requirements of the racquet in such sports is that it impart spin to the ball. This is necessary to improve the speed of the game (as in deep topspin drives), the control of the ball (as in a defensive underspin return), and the ball's placement and trajectory (as in a sidespin tennis serve). Traditionally this has been done by the player so manipulating the rigid racquet as to produce the required spin- that is, by moving the racquet on a plane roughly perpendicular to the path of the ball as the ball contacts the racquet facing. However, considerably more spin could be imparted to the ball if the facing could move in it's own plane seperately from the motion of the racquet frame and handle. The new and radical invention proposed here greatly increases both the control and the maximum magnitude of spin by the use of a moving facing within the racquet itself.

SUMMARY OF THE INVENTION

This invention relates to game racquets and more particularly to racquets designed to impart spin to the ball.

It is an object of the present invention to provide a racquet capable of imparting more spin to the ball than a conventional rigid racquet.

It is also an object of the invention to provide a better control of the amount of spin imparted to the ball.

It is further an object of this invention to permit the production of two opposite spins (e.g. topspin and underspin) with the racquet in any given configuration.

It is also an object of this invention that the racquet may retain many features of conventional racquets, as long as these features do not interfere with the spin imparting and related mechanisms.

The present invention provides a racquet with a rigid frame attached by some mechanisms (e.g. bearings) to a facing which can move in it's own plane even as the frame is stationary. Now the total in-plane velocity of the facing as it contacts the ball will be the sum of the racquet velocity parallel to the facing as produced by the player's stroke plus the facing velocity with respect to the racquet. Thus this genus of a radically new racquet permits the player to impart much greater spin to the ball and to better control that spin, with an ensuing improvement in the player's game"to "racquet. By increasing the facing surface in-plane velocity one may increase the spin imparted to the ball upon its contact with the moving facing. Thus by the player causing the facing to move in some desired manner, he may impart the desired spin to the ball. The distinguished feature of this game racquet is then the mounting of a movable ball-contacting facing through the means of bearings on a substantially rigid frame; so as to enable the player to impart more spin to the ball and to better control that spin, by causing and controlling the motion of the facing. No game racquet now exists which similarly has a bearing-mounted movable facing capable of imparting spin to the ball over and above that arising from the motion of the racquet frame itself. In the preferred mode of operation the player by manipulating a control operationally connected through a mechanical transmission system to the facing causes said facing to move in such a manner as to impart the desired spin to the ball (e.g. rotates a closed loop facing around supporting spools)."

BRIEF DESCRIPTION OF THE DRAWINGS

The invention will hereinafter be more fully described with references to the accompanying drawings in which.

It is understood that the invention as described above and as specified in the claims is not limited to a specific device as illustrated in the Figures. The species shown in the Figures was chosen for illustrating several possible features of the invention simultaneously and is not necessarily the optimal embodiment of the invention.

DETAILED DESCRIPTION OF THE ILLUSTRATED EMBODIMENTS

Figure 1:
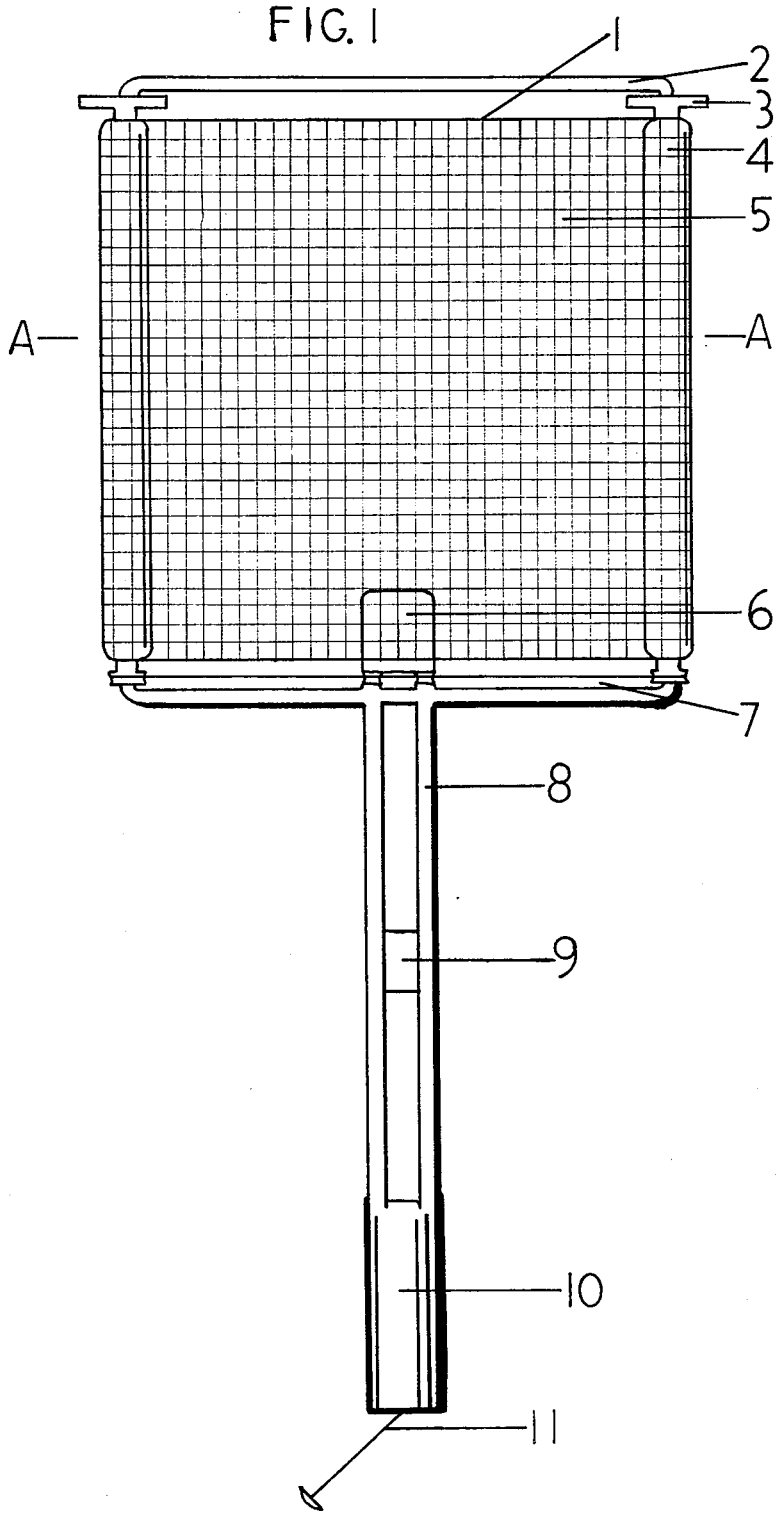
FIG. 1 is a frontal view of one species of this generic invention.
Figure 2:
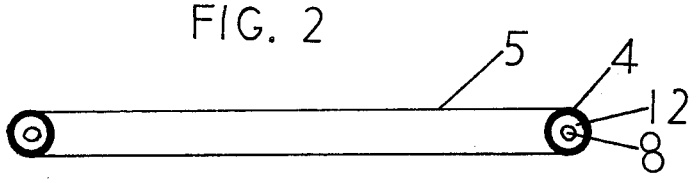
FIG. 2. is the cross section A—A of this species, as indicated in FIG. 1.

The basic structure of the particular species of this racquet which is illustrated is a rigid frame consisting of the upper frame 2, the lower frame 8, and the grip 10. To the frame are attached two rotatable spools 4 by means by bearings 12. Ball, roller, journal, or other type of bearings may be used. The facing 5 consisting of a mesh of strings (e.g.) of nylon forms a closed band held in tension around the two spools. The end strings 1 of the mesh are held in tension at the reduced radius ends of the spool and also provide the tension in the vertical strings by transmitting most of this vertical tension load to the ends of the spools 4 which then sustain the resulting compressive load (in the picture as shown). The spools may be driven by means of (a) rubbing the discs or wheels 3 against the playing surface or other surface, (b) moving the plunger 9 up or down (as shown in the picture), and/or c) pulling the pullchord 11. The discs, plunger, and pullchord are all operatively connected to the spools. The transmission, as well as any springs, dampers, motors, energy storage mechanisms, and/or switches, is contained in the control box 6. The final drive to the spools is by means of the cable or chain 7. Once again, FIG. 1 is a frontal view of the racquet, and FIG. 2 is the section A-A noted in FIG. 1.

As mentioned previously, the player imparts spin to the ball by causing the facing to rotate around the two spools 4 as he hits the ball. Again, the energy required to rotate the facing may come from (a) a motor, (b) the movement of discs 3 against some surface by the player moving the whole racquet frame with respect to that surface, (c) the player moving the plunger 9 up or down, and/or (d) the player pulling a pullchord such as 11. For instance, the player may push a plunger to provide topspin, pull it for underspin, and vary the facing speed by varying the speed at which he moves the plunger, if there is a direct mechanical linkage between the plunger and the facing. However, the operational details may vary considerably for different species of this invention, and are not of particular importance in distinguishing this invention from other existing devices. In the illustrated embodiment, the motor, plunger, and pullchord are operatively connected to the transmission in control box 6, which in turn is connected to the spools by the drive chain or chord 7. The transmission may contain gears, clutches, rotation reversal mechanisms, and/or other mechanisms. Thus the player can rotate the facing by means of various mechanical inputs or by means of a motor, which could be of electrical, combustion, hydraulic, or other type. Energy storage devices, springs, and/or dampers may also be contained in the control box 6.

While the invention has been described in considerable detail with reference to certain illustrated embodiments, it will be understood that modifications and variations may be made within the spirit and scope of the invention as defined in the appended claims. The above description refers to only one species of the generic invention.

What is claimed is:

1. A game racquet-containing in combination:

a substantially rigid frame in the form of a handle and a head;

two rotatable spools mounted on members by means of bearings on opposite sides of said head, said spools having approximately parallel axes of rotation;

a ball-contacting facing containing closed loops of strings held in tension around the aforementioned spools;

wherein forces applied to said facing between said spools in a non-perpendicular direction with respect to said facing, or torques applied directly to said spools to cause them to rotate will provide movement of said facing around said members thus imparting a spin to a ball that contacts said facing during said rotation.

2. The racquet of claim 1, wherein the spool tips, are of reduced radius as compared to the spool body. The spool-parallel facing tension is thus substantially maintained by a corresponding compression force in the spools themselves.

3. The racquet of claim 1, wherein operative means are furnished for the player to cause said motion of said facing.

4. The racquet of claim 1, wherein said motion of said facing is powered to some extent by energy from the game player.

5. The racquet of claim 1, wherein said motion of said facing is powered to some extent by a control mechanism attached to the handle and operatively connected to the facing.

6. The racquet of claim 1, wherein said motion of said facing is powered to some extent by the contact of some portion of the racquet along some surface.

7. The racquet of claim 1, wherein said motion of said facing is powered to some extent by a motor operatively connected to said facing.

* * * * *